US008892024B2

(12) United States Patent
Deguchi et al.

(10) Patent No.: US 8,892,024 B2
(45) Date of Patent: Nov. 18, 2014

(54) IMAGE FORMING APPARATUS AND CARTRIDGE

(75) Inventors: Hideaki Deguchi, Nagoya (JP); Keita Hironaka, Aichi-ken (JP); Masahiro Ishii, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 348 days.

(21) Appl. No.: 13/222,593

(22) Filed: Aug. 31, 2011

(65) Prior Publication Data

US 2012/0051820 A1 Mar. 1, 2012

(30) Foreign Application Priority Data

Aug. 31, 2010 (JP) ..... 2010-193491

(51) Int. Cl.
*G03G 15/14* (2006.01)
*G03G 15/00* (2006.01)

(52) U.S. Cl.
CPC ..... *G03G 15/6532* (2013.01)
USPC ..... 399/398; 399/399; 271/307

(58) Field of Classification Search
USPC ..... 399/398, 399, 116, 123; 101/408, 409; 226/5; 271/307, 308, 311, 312
See application file for complete search history.

(56) References Cited

U.S. PATENT DOCUMENTS 4,771,310 A * 9/1988 Leo et al. ..... 399/323
6,735,412 B2 * 5/2004 Berg et al. ..... 399/323
7,466,949 B2 * 12/2008 Satoh et al. ..... 399/323
2007/0166083 A1 * 7/2007 Satoh et al. ..... 399/323
2009/0285599 A1 * 11/2009 Isokawa ..... 399/111

FOREIGN PATENT DOCUMENTS

JP 53-139847 U 11/1978
JP 54-020147 U 2/1979
JP 57027285 A * 2/1982
JP H09-281810 A 10/1997

OTHER PUBLICATIONS

JP Notice of Reasons for Rejection mailed Jan. 7, 2014, JP Appln. 2010-193491, English translation.

* cited by examiner

*Primary Examiner* — Matthew G Marini
(74) *Attorney, Agent, or Firm* — Banner & Witcoff, Ltd.

(57) ABSTRACT

An image forming apparatus or cartridge is provided that includes an image carrier configured to be rotated while carrying a developer and transfer the developer onto a recording sheet at a transfer position. The image forming apparatus or cartridge may include a separating member disposed downstream from the transfer position in a rotating direction of the image carrier. The separating member may include a contact portion configured to contact the image carrier to separate the recording sheet from the image carrier, and an aperture configured to allow the developer to pass through the separating member from a first side of the separating member to a second side of the separating member opposite the first side, wherein the aperture is positioned farther away from the image carrier than the contact portion.

12 Claims, 5 Drawing Sheets

IMAGE FORMING APPARATUS AND CARTRIDGE

CROSS REFERENCE TO RELATED APPLICATION

This application claims priority from Japanese Patent Application No. 2010-193491, filed on Aug. 31, 2010, the entire subject matter of which is incorporated herein by reference.

FIELD

An image forming unit including an image carrier and a separating member for separating a recording sheet from the image carrier is disclosed.

BACKGROUND

An image forming apparatus including a photoconductor drum (image carrier) that carries toner images and a separating member for separating a sheet adhering to the photoconductor drum is known. In this related art, the separating member is brought into contact with the photoconductor drum, thereby separating a sheet adhering to the photoconductor drum by use of the separating member.

When a separating member is brought into contact with a photoconductor drum, toner remaining on the photoconductor drum that has not been transferred from the photoconductor drum onto a sheet accumulates on the surface of the separating member, which may stain a sheet when a subsequent separating operation is performed.

SUMMARY

According to certain aspects, even if developer remaining on an image carrier is separated by a separating member, part of the developer passes from a contact portion of the separating member through an aperture provided farther away from the image carrier than the contact portion and returns to the image carrier.

According to certain aspects, it is possible to suppress the accumulation of developer on the surface of a separating member, which reduces the potential for a recording sheet from being stained when the recording sheet is separated by the separating member.

DETAILED DESCRIPTION

Overall Configuration of Laser Beam Printer

Figure 1:
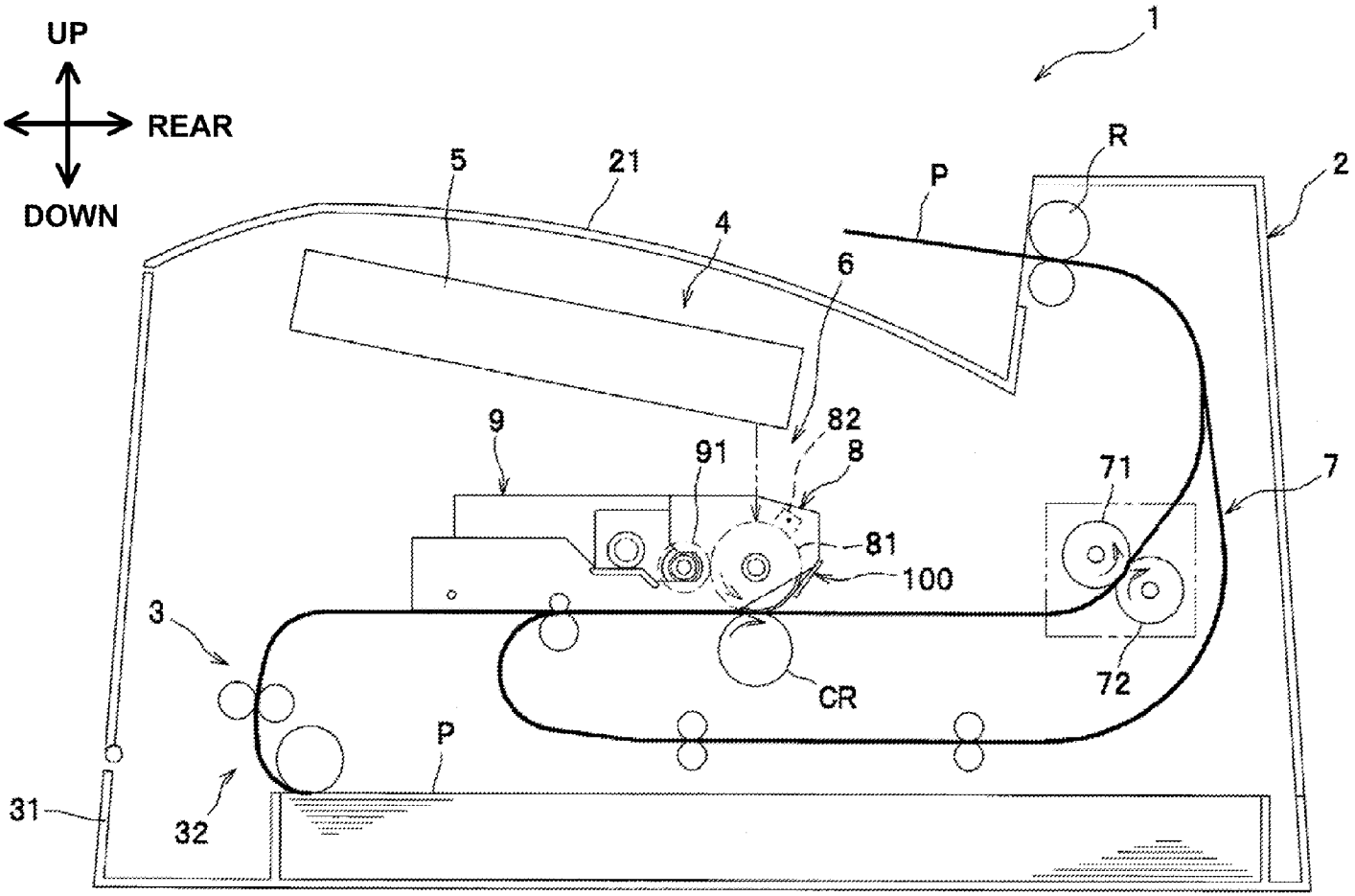
FIG. 1 illustrates a laser printer according to an illustrative embodiment.

An illustrative embodiment will be described in detail with reference to the drawings. In the following description, the overall configuration of a laser beam printer will first be discussed, and then, illustrative features will be described in detail.

In the following description, the directions viewed from the viewpoint of a user using the laser printer. More specifically, in FIG. 1, the left side in the drawing is the "front side (near side)", the right side in the drawing is the "rear side (far side)", the far side in the drawing is the "left side", and the near side in the drawing is the "right side". The vertical direction in the drawing is the "up and down direction".

A laser printer 1 includes, as shown in FIG. 1, a feeder 3 for feeding a recording sheet, such as paper P described herein as an example, into a main body 2 and an image forming device 4 for forming an image on the paper P.

The feeder 3 includes a feed tray 31 which is detachably attached to the bottom of a main body 2 and a feed mechanism 32 that feeds paper P stored within the feed tray 31 toward the image forming device 4.

The image forming device 4 includes a scanner unit 5, an image forming unit, such as process cartridge 6 described herein as an example, a transfer member such as transfer roller CR described herein as an example, and a fixing unit 7.

The scanner unit 5 is disposed at the top portion of the main body 2, and includes a laser emitting portion, a polygon mirror, a lens, and a reflector, all of which are not shown. In the scanner unit 5, a laser beam scans the surface of an image carrier, such as a photoconductor drum 81 described herein as an example.

The process cartridge 6 is detachably attached to the main body 2 and includes a drum cartridge 8 having the photoconductor drum 81 and a charger 82 and a developing cartridge 9 having a developing roller 91 and a container (not shown) for holding developer, for example toner. At the bottom portion of the rear side of the process cartridge 6 (more specifically, the drum cartridge 8), a separating member such as a separating film 100 described herein as an example, is provided.

In FIG. 1, for convenience sake, the separating film 100 is exaggerated in order to make it noticeable.

In the process cartridge 6, after the surface of the rotating photoconductor drum 81 is uniformly charged by the charger 82, is the surface can be exposed to a laser beam emitted from the scanner unit 5 with fast scanning. Accordingly, the potential of the exposed portion can be decreased, whereby an electrostatic latent image based on image data is formed on the surface of the photoconductor drum 81.

Then, toner stored within the developing cartridge 9 is supplied to the electrostatic latent image formed on the photoconductor drum 81 by using the developing roller 91 which is driven and rotated, thereby forming a toner image on the surface of the photoconductor drum 81. Thereafter, when the paper P passes between the photoconductor drum 81 and the transfer roller CR, the toner image carried on the surface of the photoconductor drum 81 can be transferred onto the paper P at a transfer position CP (see FIG. 2(*c*)) through cooperation of the photoconductor drum 81 and the transfer roller CR.

The fixing unit 7 includes a heating roller 71 and a pressure roller 72, which is disposed to oppose the heating roller 71 so as to press the heating roller 71. In the fixing unit 7 configured as described above, while the paper P is passing between the heating roller 71 and the pressure roller 72, the toner transferred onto the paper P is thermally fixed.

The paper P which is thermally fixed by use of the fixing unit 7 is transferred to a discharge roller R disposed on the downstream side of the fixing unit 7, and is discharged onto a discharge tray 21 by the discharge roller R.

Detailed Structure of Separating Film

An illustrative separating member realized as a separating film 100 will be described below in detail.

Figure 2A:
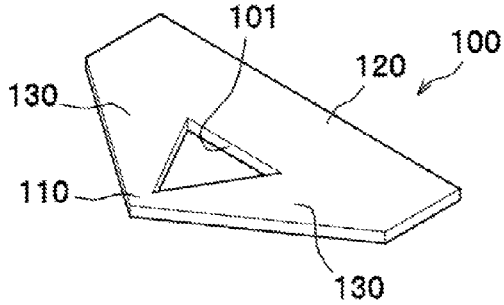
FIG. 2(*a*) is a perspective view illustrating a separating member, part FIG. 2(*b*) illustrates a drum cartridge as viewed from two separating members, and FIG. 2(*c*) is a sectional view illustrating a separating member and a photoconductor drum.
Figure 2B:
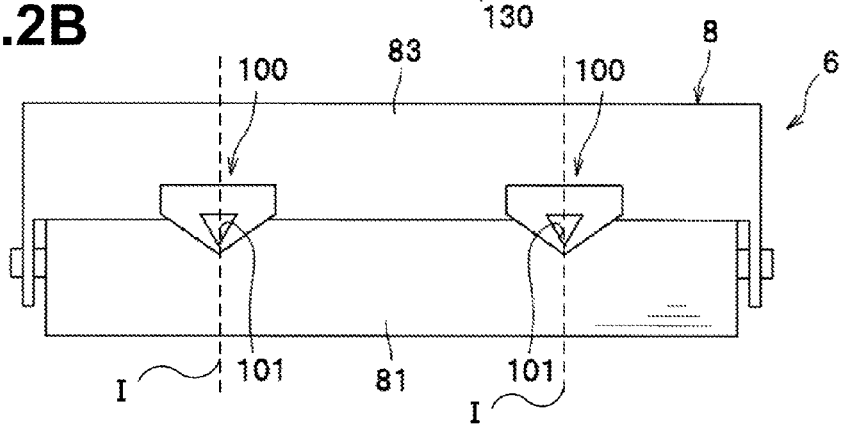
Figure 2C:
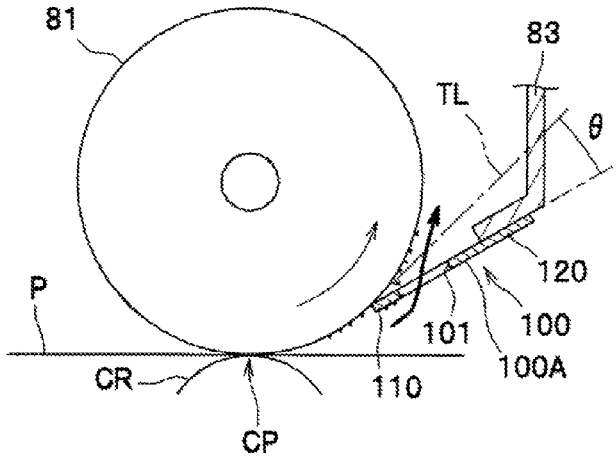

The separating film 100 can be made of a resin-made sheet material, such as polyethylene terephthalate (PET). As shown in FIGS. 2(*a*)-2(*c*), two separating films 100 are provided substantially symmetrically at the right and left portions of the photoconductor drum 81 with respect to the horizontal center of the photoconductor drum 81 (center in the direction of the rotational axis). The separating film 100 contacts the photoconductor drum 81. As a result, paper P adhering to the photoconductor drum 81 is separated therefrom.

The separating film 100 can be formed substantially in an inverted V shape having a tapered end, which serves as a contact portion 110 which is brought into contact with the photoconductor drum 81. The separating film 100 also has an aperture 101 defined therein. The aperture 101 is formed in a triangular shape provided substantially at the center of the inverted V shape such that the apex of the aperture 101 faces the contact portion 110. More specifically, the separating film 100 includes the contact portion 110 which is brought into contact with the photoconductor drum 81, a fixed portion 120 which is to be fixed to a casing 83 of the drum cartridge, and a pair of extending portions 130 which are obliquely (obliquely with respect to the direction of the rotational axis of the photoconductor drum 81) extending from both ends of the fixed portion 120 to the contact portion 110.

Then, in the separating film 100, the triangular aperture 101 for allowing toner to pass therethrough is formed between the contact portion 110 and the fixed portion 120. The toner is allowed to pass through the separating film 100 from a first side to a second side opposite the first side thereby allowing the toner to be returned to the photoconductor drum 81. Also, the aperture 101 is positioned farther away from the photoconductor drum 81 than the contact portion 110, but closer than the fixed portion 120. In addition, the contact portion 110 and the aperture 101 are positioned in an imaginary plane I perpendicular to an axial direction of the photoconductor drum 81.

With this configuration, even if toner remaining on the photoconductor drum 81 that has not been transferred onto the paper P at the transfer position CP is separated at the position of the contact portion 110, the toner does not entirely remain on a surface 100A of the separating film 100, and part of the toner passes through the aperture 101 so as to return to the photoconductor drum 81 (to the electrostatic latent on the charged photoconductor drum 81).

The fixed portion 120 is formed in a rectangular shape extending in the horizontal direction, and is fixed to the casing 83 with, for example, an adhesive, such that the fixed portion 120 is positioned farther away from the photoconductor drum 81 than the contact portion 110. More specifically, the fixed portion 120 is fixed to the casing 83 such that the angle θ between the separating film 100 and the tangent line TL which is drawn from the contact point between the separating film 100 and the photoconductor drum 81 toward the fixed portion 120 and away from the photoconductor drum 81 is an acute angle.

The extending portions 130 are disposed at the right and left sides of the separating film 100 with the aperture 101 therebetween, and are formed such that they flare out from the contact portion 110 toward the fixed portion 120. That is, the extending portions 130 disposed on opposites sides of the aperture 101 extend away from the contact portion 110 with an increasing width. With this arrangement, the trailing ends (toward the fixed portion 120) of the extending portions 130 are wider than the leading ends (toward the contact portion 110). Accordingly, even though the separating film 100 is provided with the aperture 101, the strength of the separating film 100 can be maintained, and the separating film 100 is caused to smoothly slide on the photoconductor drum 81. Additionally, the separating film 100 is configured such that the leading ends of the extending portions 130 are narrower than the trailing ends thereof. With this configuration, adhesion of toner onto the separating film 100 can be effectively reduced.

The function of the aperture 101 of the separating film 100 will now be described.

As shown in FIG. 2(*c*), if toner is not entirely transferred from the photoconductor drum 81 onto the paper P at the transfer position CP, the toner may be separated from the photoconductor drum 81 by the contact portion 110 of the separating film 100 provided on the downstream side of the transfer position CP. In this case, part of the toner separated from the photoconductor drum 81 adheres to and remains on the surface 100A of the contact portion 110, but on the other hand, the remaining toner reaches the aperture 101 through the contact portion 110.

Upon reaching the aperture 101, the toner is attracted to the photoconductor drum 81 (more specifically, to the electrostatic latent image) and returns to the photoconductor drum 81. This makes it possible to prevent a large amount of toner from remaining on the surface 100A of the separating film 100. It should be noted that the toner returned to the photoconductor drum 81 is recovered by the developing roller 91 (see FIG. 1).

As described above, in this illustrative embodiment, the following advantages can be obtained.

Toner is less likely to remain on the surface 100A of the separating film 100. Thus, it is possible to prevent the paper P from being stained when the paper P is separated by the separating film 100.

The extending portions 130 are formed such that they flare out from the contact portion 110 toward the fixed portion 120. Accordingly, the strength of the separating film 100 provided with the aperture 101 can be maintained.

The disclosure is not restricted to the above-described illustrative embodiment and may be applied in various modes, which will be described below by way of example. In the drawings which are referred to in the following description, elements similar to those of the foregoing illustrative embodiment are designated by like reference numerals in other illustrative embodiments, and an explanation thereof is thus omitted.

Figure 3A:
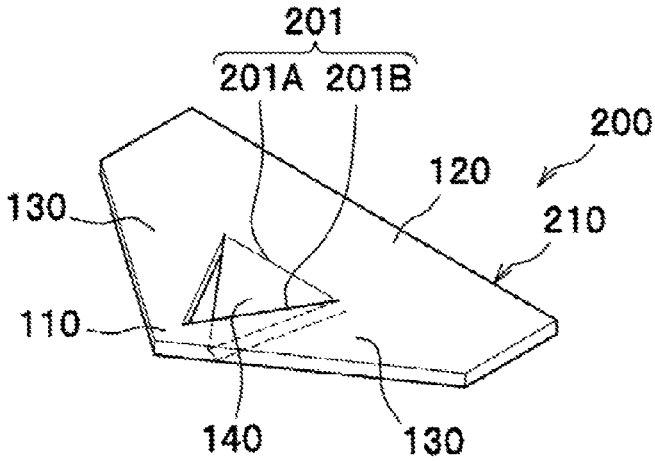
FIGS. 3(*a*) and 3(*b*) are a perspective view and a sectional view, respectively, illustrating a separating member according to another illustrative embodiment.
Figure 3B:
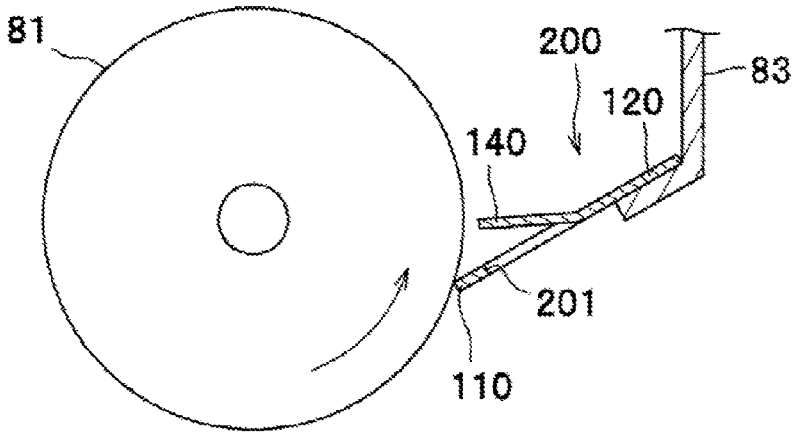

In the above-described illustrative embodiment, a portion in the form of an aperture which corresponds to the aperture 101 of a film material is entirely cut out. According to another illustrative embodiment, for example, as shown in FIGS. 3(*a*) and 3(*b*), a flap 140 may be bent so as to form an aperture 201 without being removed from a separating film 200. In other words, the separating film 200 includes a body, for example a sheet material body 210 as described herein, and the flap 140. The sheet material body 210 includes the contact portion 110, the fixed portion 120, and the pair of extending portions 130. The flap 140 may be integrally formed with the sheet material body 210. The periphery of the aperture 201 is defined by inner periphery portions 201A and 201B of the sheet material body 210. The aperture 201 can be configured by bending the flap 140 from the sheet material body 210 toward the photoconductor drum 81 by using the inner periphery portion 201A as a bending line. That is, the flap 140 extends from the inner periphery portions 201A toward the photoconductor drum 81.

With this configuration, the flap 140 remains in the sheet material body 210. Accordingly, when forming the separating film 200, dust flakes or the like are not generated by separating the flap 140, thereby making it possible to reduce the cost necessary for disposing of dust flakes. Additionally, the flap 140 is bent toward the photoconductor drum 81, thereby making it possible to prevent paper separated at the position of the separating film 200 from getting caught by the flap 140.

Figure 4A:
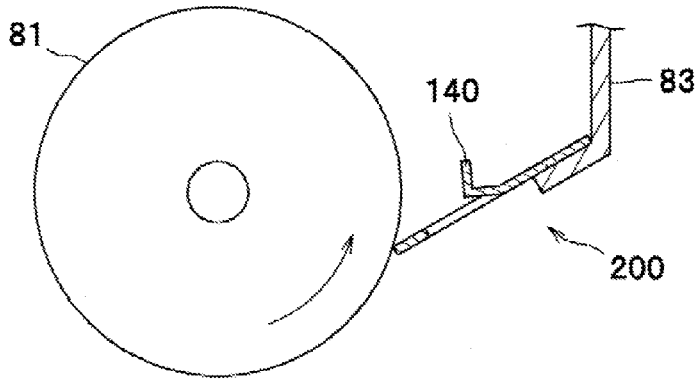
FIGS. 4(*a*) and 4(*b*) are sectional views illustrating another illustrative embodiment of a separating member.
Figure 4B:
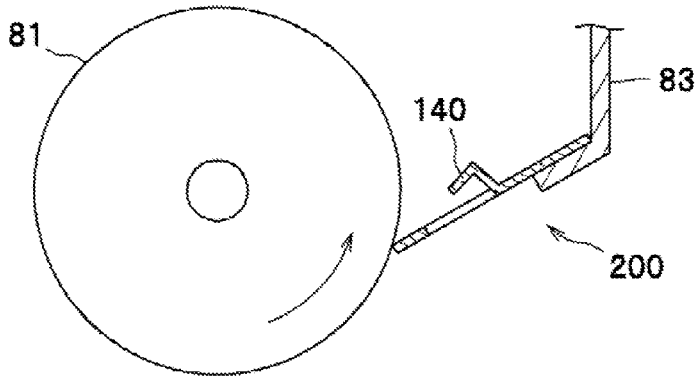
Figure 5A:
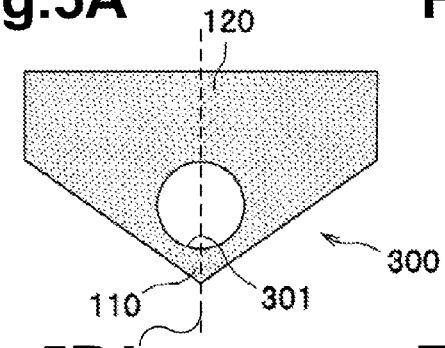
FIGS. 5(*a*) through 5(*g*) illustrate still other illustrative embodiments of a separating member.
Figure 5E:
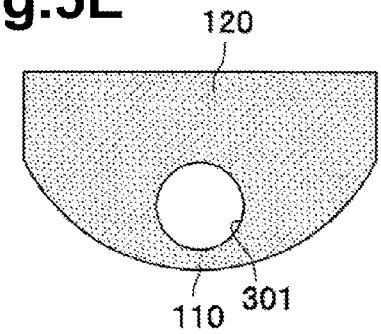
Figure 5B:
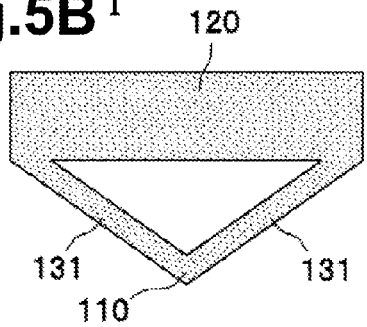
Figure 5F:
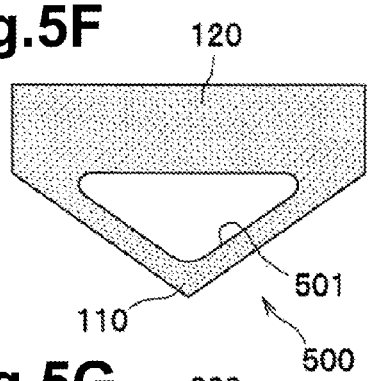
Figure 5C:
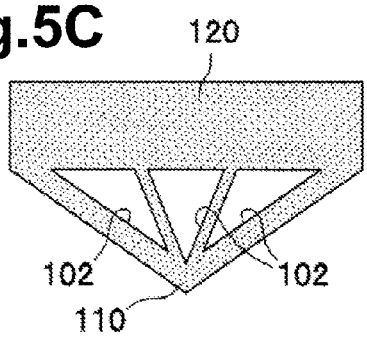
Figure 5G:
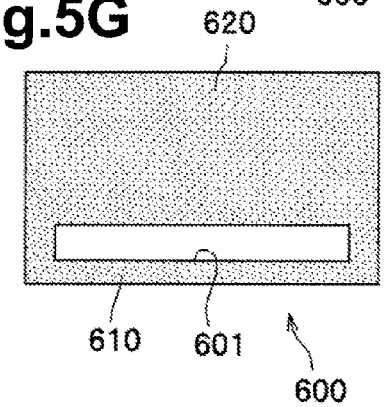
Figure 5D:
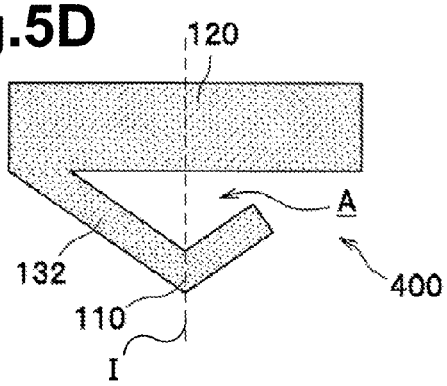

As shown in FIGS. 4(*a*) and 4(*b*), after bending the flap 140 toward the photoconductor drum 81, it may be further bent such that the leading end thereof is separated from the photoconductor drum 81 (separated farther away from the photoconductor drum 81 than the position of the aperture forming portion shown in FIG. 3). As such, the flap 140 may include a first portion that extends toward the image carrier and a second portion extending from the first portion as shown in FIGS. 4(*a*) and 4(*b*). With this arrangement, it is possible to prevent the photoconductor drum 81 from sliding against the flap 140, which otherwise can cause the photoconductor drum 81 to wear.

The number of times the flap 140 is bent is not restricted to two times. The flap 140 may be bent three or more times.

In the above-described illustrative embodiment, the aperture 101 is formed in a triangular shape. However, the aperture is not restricted to this shape. For example, an aperture 301 may be formed in a circular shape, as shown in FIG. 5(*a*). With this configuration, since the circular aperture 301 does not have any corners on which stress is concentrated, the likelihood of a separating film 300 cracking is substantially reduced relative to an implementation in which an aperture is formed in a polygonal shape.

In the above-described illustrative embodiment, the extending portions 130 are formed such that they flare out from the contact portion 110 toward the fixed portion 120. However, the extending portions are not limited to this configuration. For example, as shown in FIG. 5(*b*), extending portions 131 may be formed so as to extend with a fixed width from the contact portion 110 toward the fixed portion 120.

In the above-described illustrative embodiment, only one aperture 101 is formed. However, a plurality of apertures 102 may be formed as shown in FIG. 5(*c*).

In the above-described illustrative embodiment, the space that allows toner to pass therethrough is formed as the aperture 101. However, other configuration may be employed such as an opening, for example a notch-like space A, may be formed as shown in FIG. 5(*d*). More specifically, a separating film 400 may include an extending portion 132 which obliquely extends from the fixed portion 120 toward the contact portion 110 (obliquely with respect to the direction of the rotational axis of the photoconductor drum 81). With this structure, too, the space A for allowing toner to pass therethrough is formed farther away from the photoconductor drum 81 than the contact portion 110, which can prevent the accumulation of toner on the surface of the separating film 400. That is, the notch-like space A is defined by the separating film 400 and configured to allow toner to pass through the separating film 400 from a first side of the separating film 400 to a second side of the separating film 400 opposite the first side. The contact portion 110 and the notch-like space A are positioned in an imaginary plane I perpendicular to the axial direction of the photoconductor drum 81, and the notch-like space A is positioned farther away from the photoconductor drum 81 than the contact portion 110.

In the above-described illustrative embodiment, the edges of the contact portion 110 of the separating film 100 are formed in an angular shape (V shape). However, the other configurations are possible. For example, as shown in FIG. 5(*e*), the edges of the contact portion 110 may be formed in an arc shape.

If an aperture 501 is formed in a polygonal shape, as shown in FIG. 5(*f*), the corners of the aperture 501 may be rounded. With this configuration, the aperture 501 does not have any corners on which stress is concentrated, such that a separating film 500 may be prevented from cracking.

In the above-described illustrative embodiment, the separating film 100 is formed in an inverted V shape with a tapered end. However, other configurations may be used. For example, as shown in FIG. 5(*g*), a separating film 600 may be formed in an elongated rectangular shape extending in the horizontal direction, that is, a contact portion 610 and a fixed portion 620 may be formed with the same length in the horizontal direction. In this case, a rectangular aperture 601 extending in the horizontal direction may be formed on the downstream side of the contact portion 610 in the rotating direction. With this structure, too, advantages similar to those of the above-described illustrative embodiment can be obtained.

In the above-described illustrative embodiment, as the image forming unit, the process cartridge 6 has been described by way of example. However, the image forming unit may be an image forming apparatus, such as the laser printer 1 or a copying machine or may be a multi-function device having, for example scanning, faxing, printing and copying functionality. If the image forming apparatus is used as the image forming unit, a separating member may be fixed to the casing of the main body of the image forming apparatus such that the forward end of the separating member is brought into contact with the photoconductor drum.

In the above-described illustrative embodiment, as the transfer mechanism, the transfer roller CR has been described by way of example. However, the transfer mechanism may be a member to which a transfer bias is applied, such as a conductive brush or a conductive leaf spring.

In the above-described illustrative embodiment, as the image carrier, the photoconductor drum 81 has been described by way of example. However, the image carrier may be a belt-like photoconductor.

In the above-described illustrative embodiment, as an example of the separating film, the separating film 100 which is easy to deflect and deform has been described by way of example. However, the separating member may be a member that is difficult to deflect and deform.

In the above-described illustrative embodiment, as an example of a recording sheet, the paper P, such as a cardboard, a postcard, or thin paper, has been described by way of example. However, the recording sheet may be, for example, an OHP sheet.

The invention claimed is:

1. A cartridge comprising:

a casing;

an image carrier disposed in the casing and configured to be rotated while carrying a developer and transfer the developer onto a recording sheet at a transfer position; and a separating member disposed in the casing and disposed downstream from the transfer position in a rotating direction of the image carrier, the separating member including a contact portion configured to contact the image carrier to separate the recording sheet from the image carrier, and an aperture defined by the separating member and configured to allow the developer to pass through the separating member from a first side of the separating member to a second side of the separating member opposite the first side, wherein the contact portion and the aperture are positioned in an imaginary plane perpendicular to an axial direction of the image carrier, and the aperture is positioned farther away from the image carrier than the contact portion, and wherein the separating member is formed substantially in an inverted V shape having the contact portion as an apex, the separating member further including first and second extending portions disposed on opposite sides of the aperture and extending away from the contact portion with an increasing width, where a distance continues to increase between an edge of the first extending portion and a closest point on a periphery of the aperture as the edge extends away from the contact portion and a distance continues to increase between an edge of the second extending portion and a closest point on the periphery of the aperture as the edge extends away from the contact portion.

2. The cartridge according to claim 1, wherein:

the separating member includes a body and a flap, wherein a periphery of the aperture is defined by inner periphery portions of the body, the flap extending from one of the inner periphery portions of the body defining the periphery of the aperture toward the image carrier.

3. The cartridge according to claim 2, wherein the flap includes a first portion that extends toward the image carrier and a second portion extending from the first portion away from the image carrier.

4. The cartridge according to claim 1, wherein corners of the aperture are rounded.

5. A cartridge comprising:

a casing;

an image carrier disposed in the casing and configured to be rotated while carrying a developer and transfer the developer onto a recording sheet at a transfer position; and a separating member disposed in the casing and disposed downstream from the transfer position in a rotating direction of the image carrier, the separating member including a contact portion configured to contact the image carrier to separate the recording sheet from the image carrier, and an opening defined by the separating member and configured to allow the developer to pass through the separating member from a first side of the separating member to a second side of the separating member opposite the first side, wherein the contact portion and the opening are positioned in an imaginary plane perpendicular to an axial direction of the image carrier, and the opening is positioned farther away from the image carrier than the contact portion, and wherein the separating member is formed substantially in an inverted V shape having the contact portion as an apex, the separating member further including first and second extending portions disposed on opposite sides of the opening and extending away from the contact portion with an increasing width, where a distance continues to increase between an edge of the first extending portion and a closest point on a periphery of the opening as the edge extends away from the contact portion and a distance continues to increase between an edge of the second extending portion and a closest point on the periphery of the opening as the edge extends away from the contact portion.

6. The cartridge according to claim 5, wherein:

the separating member includes a body and a flap, wherein a periphery of the opening is defined by inner periphery portions of the body, the flap extending from one of the inner periphery portions of the body defining the periphery of the opening toward the image carrier.

7. The cartridge according to claim 6, wherein the flap includes a first portion that extends toward the image carrier and a second portion extending from the first portion away from the image carrier.

8. The cartridge according to claim 5, wherein corners of the opening are rounded.

9. An image forming apparatus comprising:

a main body having a casing;

an image carrier disposed in the casing and configured to be rotated while carrying a developer and transfer the developer onto a recording sheet at a transfer position; and a separating member disposed in the casing and disposed downstream from the transfer position in a rotating direction of the image carrier, the separating member including a contact portion configured to contact the image carrier to separate the recording sheet from the image carrier, and an aperture defined by the separating member and configured to allow the developer to pass through the separating member from a first side of the separating member to a second side of the separating member opposite the first side, wherein the contact portion and the aperture are positioned in an imaginary plane perpendicular to an axial direction of the image carrier, and the aperture is positioned farther away from the image carrier than the contact portion, and wherein the separating member is formed substantially in an inverted V shape having the contact portion as an apex, the separating member further including first and second extending portions disposed on opposite sides of the aperture and extending away from the contact portion with an increasing width, where a distance continues to increase between an edge of the first extending portion and a closest point on a periphery of the aperture as the edge extends away from the contact portion and a distance continues to increase between an edge of the second extending portion and a closest point on the periphery of the aperture as the edge extends away from the contact portion.

10. The image forming apparatus according to claim 9, wherein:

the separating member includes a body and a flap, wherein a periphery of the aperture is defined by inner periphery portions of the body, the flap extending from one of the inner periphery portions of the body defining the periphery of the aperture toward the image carrier.

11. The image forming apparatus according to claim 10, wherein the flap includes a first portion that extends toward the image carrier and a second portion extending from the first portion away from the image carrier.

12. The image forming apparatus according to claim 9, wherein corners of the aperture are rounded.

* * * * *